US005514228A

United States Patent [19]

Wyatt-Mair et al.

[11] Patent Number: 5,514,228

[45] **Date of Patent: *May 7, 1996**

[54] METHOD OF MANUFACTURING ALUMINUM ALLOY SHEET

[75] Inventors: Gavin F. Wyatt-Mair, Lafayette; Donald G. Harrington, Danville, both of Calif.

[73] Assignee: Kaiser Aluminum & Chemical Corporation, Pleasanton, Calif.

[ * ] Notice: The term of this patent shall not extend beyond the expiration date of Pat. No. 5,470,405.

[21] Appl. No.: 902,718

[22] Filed: Jun. 23, 1992

[51] Int. Cl.[6] ..... C22F 1/04

[52] U.S. Cl. ..... 148/551; 148/552; 148/693; 148/697; 148/439; 148/440

[58] Field of Search ..... 148/551, 552, 148/693, 697, 417, 439, 440; 164/459, 462, 476, 477

[56] References Cited

U.S. PATENT DOCUMENTS

| | | | |
|---|---|---|---|
| 4,282,044 | 8/1981 | Robertson et al. | 148/552 |
| 4,582,541 | 4/1986 | Dean et al. | 148/551 |
| 4,976,790 | 12/1990 | McAuliffe et al. | 148/551 |

*Primary Examiner*—David A. Simmons
*Assistant Examiner*—Robert R. Koehler
*Attorney, Agent, or Firm*—Rockey, Rifkin and Ryther

[57] ABSTRACT

A method for manufacturing aluminum sheet stock which includes hot rolling an aluminum alloy sheet stock, annealing and solution heat treating it without substantial intermediate cooling and rapid quenching.

27 Claims, 4 Drawing Sheets

ALL IN LINE FLAT SHEET PRODUCTION

HOT FEEDSTOCK
HOT ROLLING
ANNEALING
QUENCHING
COLD ROLLING
COILING

TWIN BELT HEAT SINK CASTER

PREFERRED EMBODIMENT

METHOD OF MANUFACTURING ALUMINUM ALLOY SHEET

BACKGROUND OF THE INVENTION

The present invention relates to a continuous in-line process for economically and efficiently producing aluminum alloy sheet.

PRIOR ART

Conventional manufacturing of flat rolled finish gauge stock has used batch processes which include an extensive sequence of separate steps. In the typical case, a large ingot is cast for rolling, and is then cooled to ambient temperature. The ingot is then stored for inventory management. When an ingot is needed for further processing, it is first treated to remove defects such as segregation, pits, folds, liquation and handling damage by machining its surfaces. This operation is called scalping. Once the ingot has surface defects removed, it is preheated at a required temperature for several hours to ensure that the components of the alloy are uniformly distributed and properly distributed through the metallurgical structure, and then cooled to a lower temperature for hot rolling. While it is still hot, the ingot is subjected to breakdown hot rolling in a number of passes using reversing or non-reversing mill stands which serve to reduce the thickness of the ingot. After breakdown hot rolling, the ingot is then typically supplied to a tandem mill for hot finishing rolling, after which the sheet stock is coiled, air cooled and stored. The coil is then typically annealed in a batch step. The coiled stock is then further reduced to final gauge by cold rolling using unwinders, rewinders and single and/or tandem rolling mills.

Batch processes typically used in the aluminum industry require about seventeen different material handling operations to move ingots and coils between what are typically fourteen separate processing steps. Such operations are labor intensive, consume energy, and frequently result in product damage, reworking of the aluminum and even wholesale scrapping of product. And, of course, maintaining ingots and coils in inventory also adds to the manufacturing cost.

Aluminum scrap is generated in most of the foregoing steps, in the form of scalping chips, end crops, edge trim, scrapped ingots and scrapped coils. Aggregate losses through such batch processes typically range from 25 to 40%. Reprocessing the scrap thus generated adds 25 to 40% to the labor and energy consumption costs of the overall manufacturing process.

It has been proposed, as described in U.S. Pat. Nos. 4,260,419 and 4,282,044, to produce aluminum alloy can stock by a process which uses direct chill casting or minimill continuous strip casting. In the process there described, consumer aluminum can scrap is remelted and treated to adjust its composition. In one method, molten metal is direct chill cast followed by scalping to eliminate surface defects from the ingot. The ingot is then preheated, subjected to hot breakdown followed by continuous hot rolling, batch anneal and cold rolling to form the sheet stock. In another method, the casting is performed by continuous strip casting followed by hot rolling, coiling and cooling. Thereafter, the casting is annealed and cold rolled. The minimill process as described above requires about ten material handling operations to move ingots and coils between about nine process steps. Like other conventional processes described earlier, such operations are labor intensive, consume energy and frequently result in product damage. Scrap is generated in the rolling operations resulting in typical losses throughout the process of about 10 to 15%.

In the minimill process, annealing is typically carried out in a batch fashion with the aluminum in coil form. Indeed, the universal practice in producing aluminum alloy flat rolled products has been to employ slow air cooling of coils after hot rolling. Sometimes the hot rolling temperature is high enough to allow recrystallization of the hot coils before the aluminum cools down. Often, however, a furnace coil batch anneal must be used to effect recrystallization before cold rolling. Batch coil annealing as typically employed in the prior art requires several hours of uniform heating and soaking to achieve the anneal temperature. Alternatively, after breakdown cold rolling, prior art processes frequently employ an intermediate annealing operation prior to finish cold rolling. During slow cooling of the coils following annealing, some alloying elements present in the aluminum which had been in solid precipitate, resulting in reduced strength attributable to solid solution hardening.

The foregoing U.S. Pat. Nos. 4,260,419 and 4,292,044 employ batch coil annealing, but suggest the concept of flash annealing in a separate processing line. These patents suggest that it is advantageous to slow cool the alloy after hot rolling and then reheat it as part of a flash annealing process. That flash anneal operation has been criticized in U.S. Pat. No. 4,614,224 as not economical.

There is thus a need to provide a continuous, in-line process for producing aluminum alloy sheet which avoids the unfavorable economics embodied in conventional processes of the type described.

It is accordingly an object of the present invention to provide a process for producing aluminum alloy sheet stock which can be carried out in a continuous fashion without the need to employ separate batch operations.

It is a more specific object of the invention to provide a process for commercially producing an aluminum alloy gauge sheet stock in a continuous process which can be operated economically and provide a product having equivalent or better metallurgical properties.

These and other objects and advantages of the invention appear more fully hereinafter from a detailed description of the invention.

SUMMARY OF THE INVENTION

The concepts of the present invention reside in the discovery that it is possible to combine casting, hot rolling, annealing and solution heat treating, quenching and optional cold rolling into one continuous in-line operation for the production of aluminum alloy sheet stock. As used herein, the term "anneal" refers to a heating process that causes recrystallization to produce uniform formability and control caring. Annealing times as referred to herein define the total time required to heat up the material and complete annealing. Also, as used herein, the term "solution heat treatment" refers to a metallurgical process of dissolving alloys elements into solid solution and retaining elements in solid solution for the purpose of strengthening the final product. Furthermore, the term "flash annealing" as used herein refers to an anneal or solution heat treatment that employs rapid heating of a moving strip as opposed to slowly heating a coil. The continuous operation in place of batch processing facilitates precise control of process conditions and therefore metallurgical properties. Moreover, carrying out the process steps continuously and in-line eliminates costly materials handling steps, in-process inventory and losses associated with starting and stopping the processes.

The process of the present invention thus involves a new method for the manufacture of aluminum alloy sheet stock utilizing the following process steps in one, continuous in-line sequence:

(a) A hot aluminum feedstock is hot rolled to reduce its thickness;

(b) The hot reduced feedstock is thereafter annealed and solution heat treated without substantial intermediate cooling;

(c) The annealed and solution heat treated feedstock is thereafter immediately and rapidly quenched to a temperature suitable for cold rolling; and (d) The quenched feedstock is, in the preferred embodiment of the invention, subjected to cold rolling to produce heat treated sheet stock having desired thickness and metallurgical properties.

In accordance with a preferred embodiment of the invention, the strip is fabricated by strip casting to produce a cast thickness less than 1.0 inches, and preferably within the range of 0.1 to 0.2 inches. In another preferred embodiment, the width of the strip, slab or plate is narrow, contrary to conventional wisdom. This facilitates ease of in-line threading and processing, minimizes investment in equipment and minimizes cost in the conversion of molten metal to the sheet stock.

In accordance with yet another preferred embodiment of the invention, the feedstock is strip cast using the concepts described in co-pending application Ser. No. 07/902,997, filed concurrently herewith. In the method and apparatus described in the foregoing pending application, the feedstock is strip cast on at least one endless belt formed of a heat conductive material to which heat is transferred during the molding process, after which the belt is cooled when it is not in contact with the metal, as described in detail in the foregoing application, the disclosure of which is incorporated herein by reference. It is believed that the method and apparatus there described represents a dramatic improvement in the economics of strip casting.

DETAILED DESCRIPTION OF THE INVENTION

Figure 1:
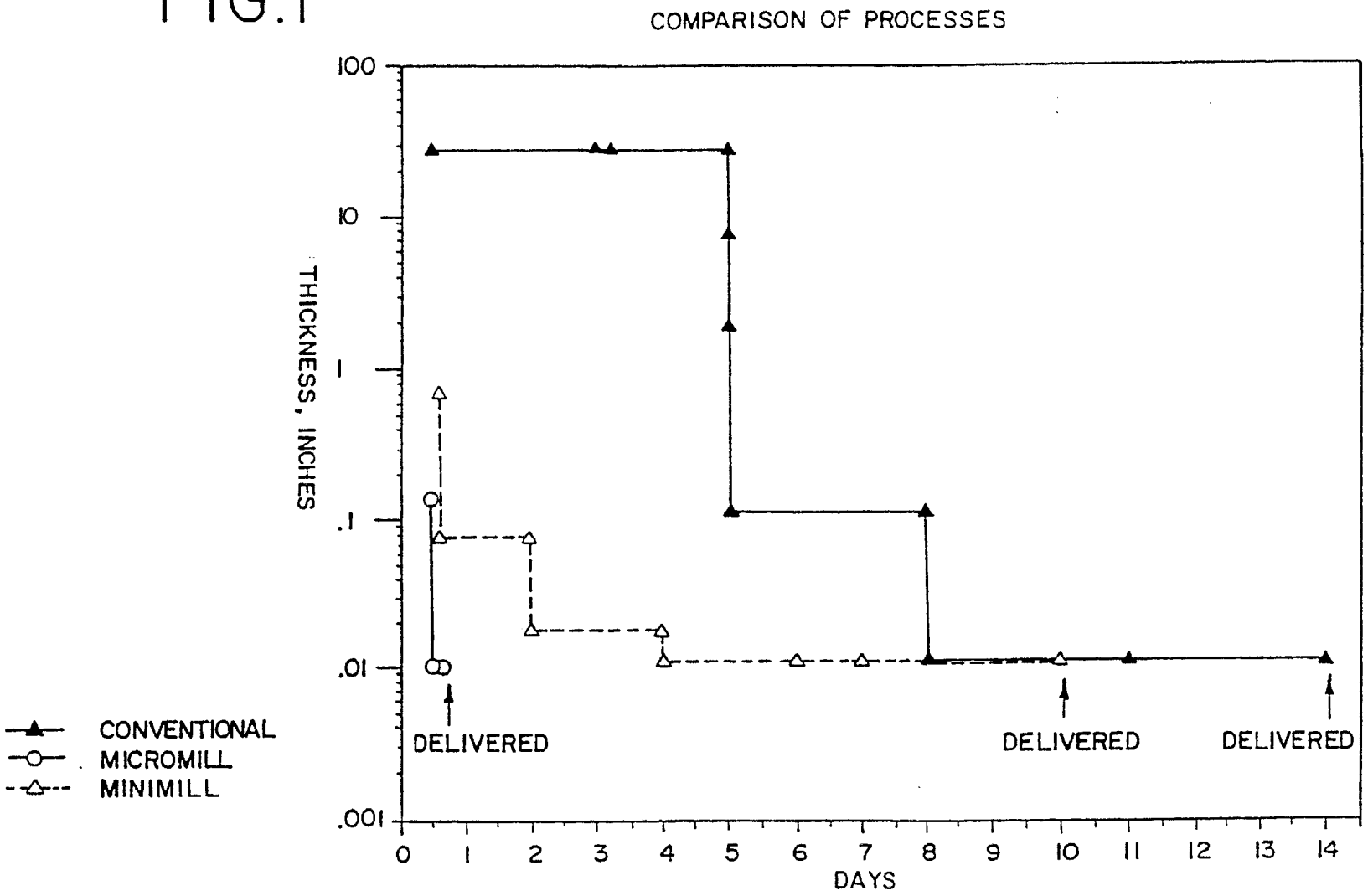
FIG. 1 is a plot of in-process thickness versus time for conventional minimill, and the "micromill" process of the present invention.

As can be seen from the foregoing prior art, the batch processing technique involves fourteen separate steps while the minimill prior art processing involves about nine separate steps, each with one or more handling operations in between. The present invention is different from that prior art by virtue of in-line flow of product through the fabrication operations and the metallurgical differences that the method produces. FIG. 1 shows the thickness of in-process product during manufacture for conventional, minimill, and micromill processes. The conventional method starts with 30-in. thick ingots and takes 14 days. The minimill process starts at 0.75-in. thickness and takes 9 days. The micromill process starts at 0.140 in. thickness and takes ½ day (most of which is the melting cycle, since the in-line process itself takes only about two minutes). The symbols in FIG. 1 represent major processing and/or handling steps.

Figure 2:
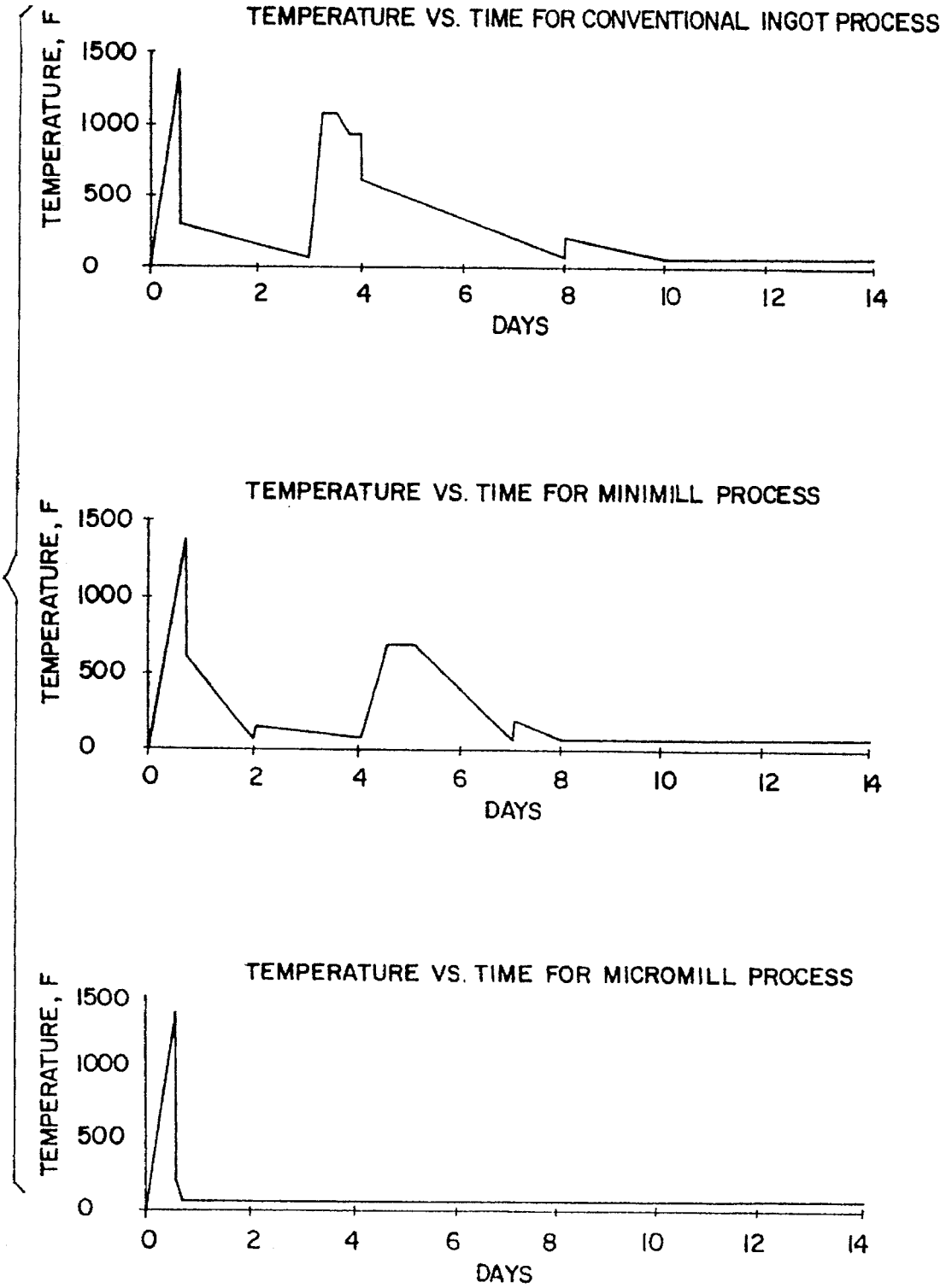
FIG. 2 is a plot of temperature versus time for the present invention, referred to as the micromill process, as compared to two prior art processes.

FIG. 2 compares typical in-process product temperature for three methods of producing can body stock. In the conventional ingot method, there is a period for melting followed by a rapid cool during casting with a slow cool to room temperature thereafter. Once the scalping process is complete, the ingot is heated to an homogenization temperature before hot rolling. After hot rolling, the product is again cooled to room temperature. At this point, it is assumed in the figure that the hot rolling temperature and slow cool were sufficient to anneal the product. However, in some cases, a batch anneal step of about 600° F. is needed at about day 8 which extends the total process schedule an additional two days. The last temperature increase is associated with cold rolling, and it is allowed to cool to room temperature.

In the minimill process, there is again a period by melting, followed by rapid cooling during slab casting and hot rolling, with a slow cool to room temperature thereafter. Temperature is raised slightly by breakdown cold rolling and the product is allowed to cool again slowly before being heated for batch annealing. After batch annealing, it is cooled slowed to room temperature. The last temperature increase is associated with cold rolling and it is allowed to cool to room temperature.

In the micromill process of the preferred embodiment of the present invention, there is a period for melting, followed by a rapid cool during strip casting and hot rolling. The in-line anneal step raises the temperature, and then the product is immediately quenched, cold rolled and allowed to cool to room temperature.

As can be seen from FIG. 2, the present invention differs substantially from the prior art in duration, frequency and rate of heating and cooling. As will be appreciated by those skilled in the art, these differences represent a significant departure from prior art practices for manufacturing aluminum alloy can body sheet.

Figures 3, 5:
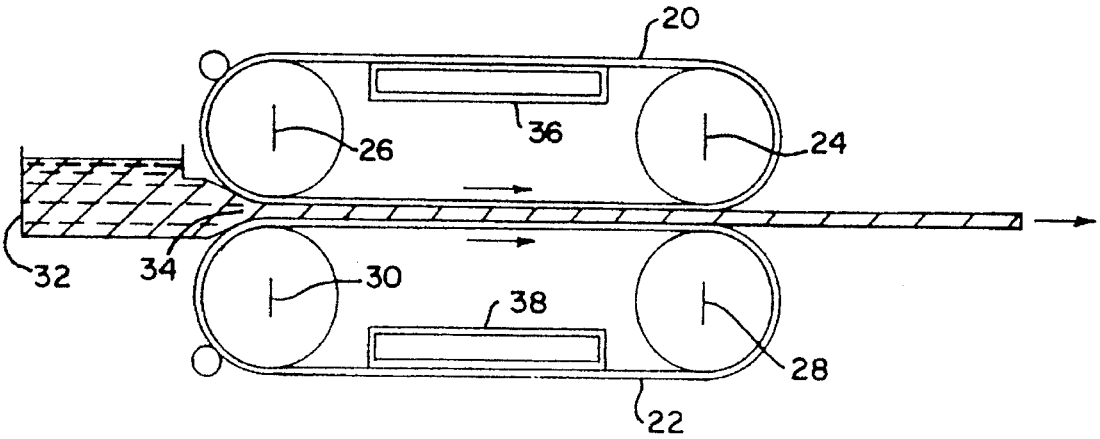
FIG. 3 is a block diagram showing the all-in-line process of the present invention for economical production of aluminum flat sheet.
FIG. 5 is a schematic view of the strip casting method and apparatus which can advantageously be employed in the practice of the present invention.
Figure 4:
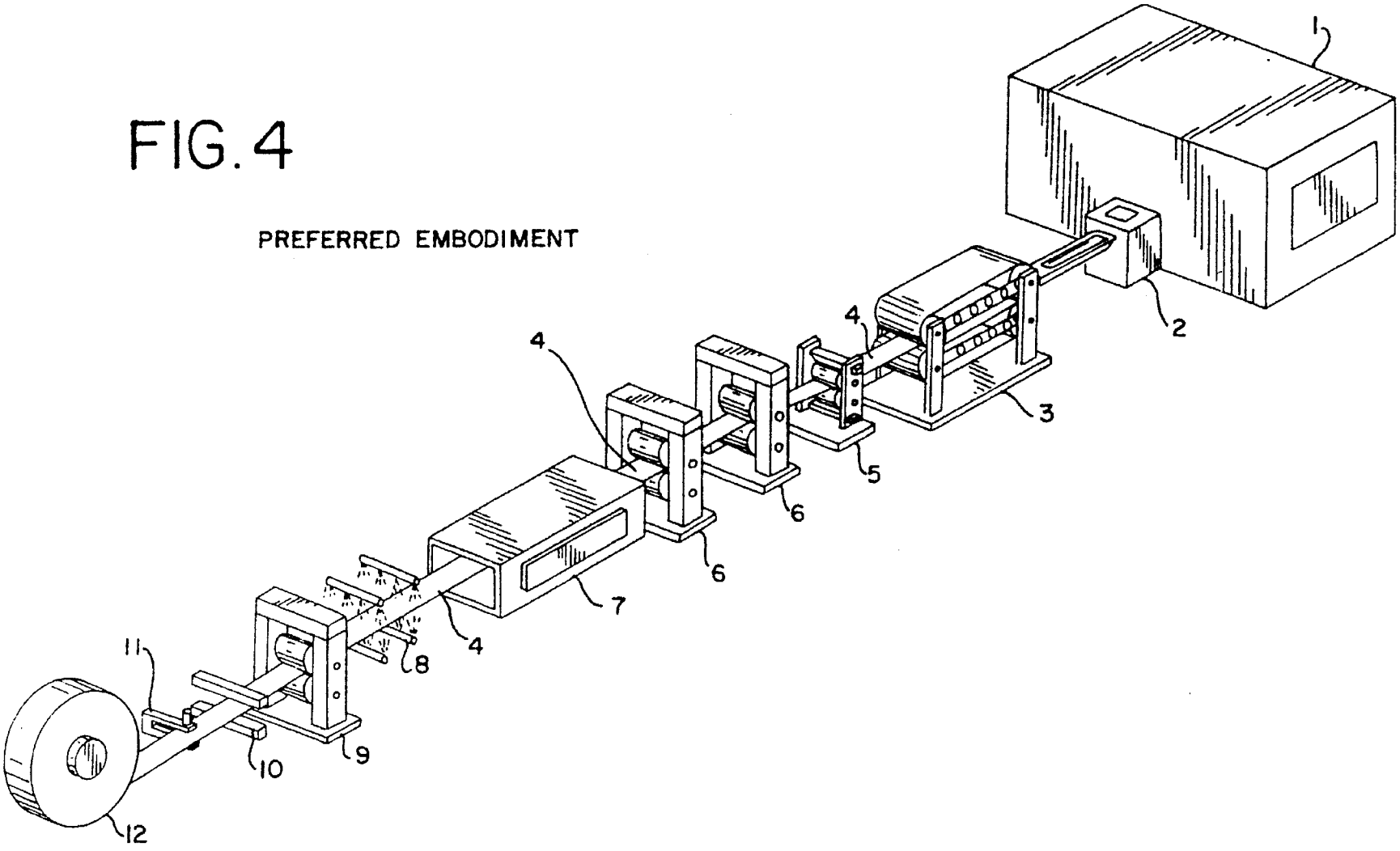
FIG. 4 shows a schematic illustration of the present invention with all-in-line processing from casting throughout finish cold rolling.

In the preferred embodiment of the invention as illustrated in FIGS. 3 and 4, the sequence of steps employed in the practice of the present invention are illustrated. One of the advances of the present invention is that the processing step for producing sheet stock can be arranged in one continuous line whereby the various process steps are carried out in sequence. The in-line arrangement of the processing steps in a narrow width (for example, 12 inches) make it possible for the invented process to be conveniently and economically located in or adjacent to sheet stock customer facilities. In that way, the process of the invention can be operated in accordance with the particular technical and throughput needs for sheet stock users.

In the preferred embodiment, molten metal is delivered from a furnace 1 to a metal degassing and filtering device 2 to reduce dissolved gases and particulate matter from the molten metal, as shown in FIG. 4. The molten metal is immediately converted to a cast feedstock 4 in casting apparatus 3. As used herein, the term "feedstock" refers to any of a variety of aluminum alloys in the form of ingots, plates, slabs and strips, delivered to the hot rolling step at the required temperature. Herein, an aluminum "ingot" typically has a thickness ranging from about 6 inches to about 36 inches, and is usually produced by direct chill casting or electromagnetic casting. An aluminum "plate," on the other hand, herein refers to an aluminum alloy having a thickness from about 0.5 inches to about 6 inches, and is typically produced by direct chill casting or electromagnetic casting alone or in combination with hot rolling of an aluminum alloy. The term "slab" is used herein to refer to an aluminum alloy having a thickness ranging from 0.375 inches to about 3 inches, and thus overlaps with an aluminum plate. The term "strip" is herein used to refer to an aluminum alloy in sheet form, typically having a thickness less than 0.375 inches. In the usual case, both slabs and strips are produced by continuous casting techniques well known to those skilled in the art.

The feedstock employed in the practice of the present invention can be prepared by any of a number of casting techniques well known to those skilled in the art, including twin belt casters like those described in U.S. Pat. No. 3,937,270 and the patents referred to therein. In some applications, it may be desirable to employ as the technique for casting the aluminum strip the method and apparatus described in co-pending application Ser. No. 07/902,997.

The strip casting technique described in the foregoing co-pending application which can advantageously be employed in the practice of this invention is illustrated in FIG. 5 of the drawing. As there shown, the apparatus includes a pair of endless belts 20 and 22 carried by a pair of upper pulleys 24 and 26 and a pair of corresponding lower pulleys 28 and 30. Each pulley is mounted for rotation, and is a suitable heat resistant pulley. Either or both of the upper pulleys 24 and 26 are driven by suitable motor means or like driving means not illustrated in the drawing for purposes of simplicity. The same is true for the lower pulleys 28 and 30. Each of the belts 20 and 22 is an endless belt and is preferably formed of a metal which has low reactivity with the aluminum being cast. Stainless steel or copper are frequently preferred materials for use in the endless belts.

The pulleys are positioned, as illustrated in FIG. 5, one above the other with a molding gap therebetween corresponding to the desired thickness of the aluminum strip being cast.

Molten metal to be cast is supplied to the molding gap through suitable metal supply means such as a tundish 32. The inside of the tundish 32 corresponds substantially in width to the width of the belts 20 and 22 and includes a metal supply delivery casting nozzle 34 to deliver molten metal to the molding gap between the belts 20 and 22.

The casting apparatus also includes a pair of cooling means 36 and 38 positioned opposite that position of the endless belt in contact with the metal being cast in the molding gap between the belts. The cooling means 36 and 38 thus serve to cool belts 20 and 22, respectively, before they come into contact with the molten metal. In the preferred embodiment illustrated in FIG. 5, coolers 36 and 38 are positioned as shown on the return run of belts 20 and 22, respectively. In that embodiment, the cooling means 36 and 38 can be conventional cooling devices such as fluid nozzles positioned to spray a cooling fluid directly on the inside and/or outside of belts 20 and 22 to cool the belts through their thicknesses. Further details respecting the strip casting apparatus may be found in the foregoing co-pending application.

The feedstock 4 from the strip caster 3 is moved through optional pinch rolls 5 into hot rolling stands 6 where its thickness is decreased. The hot reduced feedstock 4 exits the hot rolling stands 6 and is then passed to heater 7.

Heater 7 is a device which has the capability of heating the hot reduced feedstock 4 to a temperature sufficient to rapidly anneal and solution heat treat the feedstock 4.

It is an important concept of the invention that the feedstock 4 be immediately passed to the heater 7 for annealing and solution heat treating while it is still at an elevated temperature from the hot rolling operation of mills 6. In contrast to the prior art teaching that slow cooling following hot rolling is metallurgically desirable, it has been discovered in accordance with the present invention that it is more efficient to heat the feedstock 4 immediately after hot rolling to effect annealing. In addition, the heating provided by heater 7 without intermediate cooling provides much improved metallurgical properties (grain size, strength, formability) over conventional batch annealing and equal or better metallurgical properties compared to off-line flash annealing. Immediately following the heater 7 is a quench station 8 where the feedstock 4 is rapidly cooled by means of a cooling fluid to a temperature suitable for cold rolling. In the most preferred embodiment of the invention, the feedstock 4 is passed from the quenching station to one or more cold rolling stands 9 where the feedstock 4 is worked to harden the alloy and reduce its thickness to finish gauge. After cold rolling, the strip or slab 4 is coiled in a coiler 12.

As will be appreciated by those skilled in the art, it is possible to realize the benefits of the present invention without carrying out the cold rolling step as part of the in-line process. Thus, the use of the cold rolling step is an optional process step of the present invention, and can be omitted entirely or it can be carried out in an off-line fashion, depending on the end use of the alloy being processed. As a general rule, carrying out the cold rolling step off-line decreases the economic benefits of the preferred embodiment of the invention in which all of the process steps are carried out in-line.

It is possible, and sometimes desirable, to employ appropriate automatic control apparatus; for example, it is frequently desirable to employ a surface inspection device 10 for on-line monitoring of surface quality. In addition, a thickness measurement device 11 conventionally used in the aluminum industry can be employed in a feedback loop for control of the process.

It has become the practice in the aluminum industry to employ wider cast strip or slab for reasons of economy. In the preferred embodiment of this invention, it has been found that, in contrast to this conventional approach, the economics are best served when the width of the cast feedstock 4 is maintained as a narrow strip to facilitate ease of processing and enable use of small decentralized strip rolling plants. Good results have been obtained where the cast feedstock is less than 24 inches wide, and preferably is within the range of 2 to 20 inches wide. By employing such narrow cast strip, the investment can be greatly reduced through the use of small, two-high rolling mills and all other in-line equipment. Such small and economic micromills of the present invention can be located near the points of need, as, for example, can-making facilities. That in turn has the further advantage of minimizing costs associated with packaging, shipping of products and customer scrap. Additionally, the volume and metallurgical needs of a can plant can be exactly matched to the output of an adjacent micromill.

It is an important concept of the present invention that annealing and solution heat treating immediately follow hot rolling of the feedstock 4 without intermediate cooling, followed by an immediate quenching. The sequence and timing of process steps in combination with the annealing and solution heat treating and quenching operations provide equivalent or superior metallurgical characteristics in the final product. In the prior art, the industry has normally employed slow air cooling after hot rolling. Only on some occasions is the hot rolling temperature sufficient to allow annealing of the aluminum alloy before the metal cools down. It is common that the hot rolling temperature is not high enough to allow annealing. In that event, the prior art has employed separate batch annealing steps before and/or after breakdown cold rolling in which the coil is placed in a furnace maintained at a temperature sufficient to cause recrystallization. The use of such furnace batch annealing operations represents a significant disadvantage. Such batch annealing operations require that the coil be heated for several hours at the correct temperature, after which such coils are typically cooled under ambient conditions. During such slow heating, soaking and cooling of the coils, many of the elements present which had been in solution in the aluminum are caused to precipitate. That in turn results in reduced solid solution hardening and reduced alloy strength.

In contrast, the process of the present invention achieves recrystallization and retains alloying elements in solid solution for greater strength for a given cold reduction of the final product. The use of the heater 7 allows the hot rolling temperature to be controlled independently from the annealing and solution heat treatment temperature. That in turn allows the use of hot rolling conditions which maximize surface finish and texture (grain orientation). In the practice of the invention, the temperature of the feedstock 4 in the heater 7 can be elevated above the hot rolling temperature without the intermediate cooling suggested by the prior art. In that way recrystallization and solutionizing can be effected rapidly, typically in less than 30 seconds, and preferably less than 10 seconds. In addition, by avoiding an intermediate cooling step, the annealing and solution heat treatment operation consumes less energy since the alloy is already at an elevated temperature following hot rolling.

In the practice of the invention, the hot rolling exit temperature is generally maintained within the range of 300° to 1000° F., while the annealing and solution heat treatment is effected at a temperature within the range of 600° to 1200° F. for generally less than 120 seconds such as 1 to 30 seconds, and preferably 1 to 10 seconds. Immediately following heat treatment at those temperatures, the feedstock in the form of strip 4 is water quenched to temperatures (necessary to continue retain alloying elements in solid solution and to cold roll (typically less than 300° F.)).

As will be appreciated by those skilled in the art, the extent of the reductions in thickness effected by the hot rolling and cold rolling operations of the present invention are subject to a wide variation, depending upon the types of alloys employed, their chemistry and the manner in which they are produced. For that reason, the percentage reduction in thickness of each of the hot rolling and cold rolling operations of the invention is not critical to the practice of the invention. However, for a specific product, practices for reductions and temperatures must be used. In general, good results are obtained when the hot rolling operation effects reduction in thickness within the range of 40 to 99% and the cold rolling effects a reduction within the range from 20 to 75%.

One of the advantages of the method of the present invention arises from the fact that the preferred embodiment utilizes a thinner hot rolling exit gauge than that normally employed in the prior art. As a consequence, the method of the invention obviates the need to employ breakdown cold rolling prior to annealing. In addition, the method of the present invention has as a further advantage the ability to produce a finished product where desired without the cold rolling step. In that event, the feedstock, after hot rolling and annealing and solution heat treatment, is quenched to provide a heat treated product, useful without further rolling.

In some cases, the hot rolling temperature can be high enough to allow in-line self-annealing and solution heat treatment without the need for imparting additional heat to the feedstock by means of heater 7 to raise the strip temperature. In that embodiment of the invention, it is unnecessary to employ heater 7; the reduced feedstock exiting the hot rolling mills 6 is then quenched by means of quenching apparatus 8, with the same improvement in metallurgical properties. When operating in accordance with this alternative embodiment, it may be desirable to hold the reduced feedstock at an elevated temperature for a period of time to ensure recrystallization and solutionizing of the alloy. That can be conveniently accomplished by spacing the quenching apparatus 8 sufficiently downstream of the hot rolling mills 6 to permit the reduced feedstock to remain at approximately the hot rolling exit temperature for a predetermined period of time. Other holding means such as an accumulator may also be employed.

The concepts of the present invention are applicable to a wide range of aluminum alloys for use in a wide variety of products. In general, alloys from the 1000, 2000, 3000, 4000, 5000, 6000, 7000 and 8000 series are suitable for use in the practice of the present invention.

Having described the basic concepts of the invention, reference is now made to the following example which is provided by way of illustration of the practice of the invention. The sample feedstock was as cast aluminum alloy solidified rapidly enough to have secondary dendrite arm spacings below 10 microns.

EXAMPLE

This example employed an alloy having the following composition:

| Metal | Percent By Weight |
|---|---|
| Si | 0.26 |
| Fe | 0.44 |
| Cu | 0.19 |
| Mn | 0.91 |
| Mg | 1.10 |
| Al | Balance |

A cast strip having the foregoing composition was hot rolled from 0.140 inches to 0.026 inches in two passes. The temperature of the slab as it exited the rolling mill was 405° F. It was immediately heated to a temperature of 1000° F. for three seconds and water quenched. The alloy was 100% recrystallized at that stage.

The strip was then cold rolled to effect a 55% reduction in thickness. The tensile yield strength was 41,000 psi compared to 35,000 psi for conventionally processed aluminum having the same composition. Without limiting the present invention as to theory, higher strength achieved by the practice of the present invention is believed to result from increased solid solution and precipitation hardening.

It will be understood that various changes and modifications can be made in the details of procedure, formulation and use without departing from the spirit of the invention, especially as defined in the following claims.

What is claimed is:

1. A method for manufacturing of aluminum sheet stock comprising the following steps in a continuous, in-line sequence:

(a) hot rolling an aluminum alloy feedstock to reduce its thickness;

(b) annealing and solution heat treating the reduced feedstock without intermediate cooling while maintaining the temperature of the reduced feedstock for a time and level sufficient to retain alloying elements in solution; and, (c) rapidly quenching the annealed and solution heat treated reduced feedstock.

2. A method as defined in claim 1 wherein the feedstock is formed by continuous strip or slab casting.

3. A method as defined in claim 1 wherein the feedstock is formed by depositing molten aluminum alloy on an endless belt formed of a heat conductive material whereby the molten metal solidifies to form a cast strip, and the endless belt is cooled when it is not in contact with the metal.

4. A method as defined in claim 1 which includes, as a continuous in-line step, cold rolling the quenched feedstock.

5. A method as defined in claim 1 which includes, as an off-line step, cold rolling the quenched feedstock.

6. A method as defined in claim 4 which includes the further in-line step of shearing the cold rolled feedstock to lengths.

7. A method as defined in claim 1 wherein the hot rolling reduces the thickness of the feedstock by 40 to 99%.

8. A method as defined in claim 1 wherein the annealing and solution heat treating includes the in-line heating of the reduced feedstock to a temperature above the hot rolling temperature.

9. A method as defined in claim 8 wherein the reduced feedstock is heated to a temperature within the range of 600° to 1200° F.

10. A method as defined in claim 1 wherein the heat treating is performed in-line at a temperature approximately the same as the hot rolling temperature.

11. A method as defined in claim 1 wherein the heat treating is carried out at a temperature within the range of 800° to 1200° F.

12. A method as defined in claim 1 wherein the hot rolling exit temperature is within the range of 300° to 1000° F.

13. A method as defined in claim 1 wherein the heat treating is carried out in less than 120 seconds.

14. A method as defined in claim 1 wherein the heat treating is carried out in less than 10 seconds.

15. A method as defined in claim 1 wherein the reduced feedstock is quenched to a temperature less than 300° F.

16. A method as defined in claim 1 wherein the cold rolling step effects a reduction in the thickness of the feedstock of 20 to 75%.

17. A method as defined in claim 4 which includes the step of coiling the cold rolled feedstock after cold rolling.

18. A method as defined in claim 5 which includes the step of coiling the cold rolled feedstock after cold rolling.

19. A method as defined in claim 1 wherein the feedstock has a width of less than 24 inches.

20. A method for manufacturing aluminum alloy sheet comprising the following steps in continuous, in-line sequence:

(a) hot rolling an aluminum alloy feedstock to reduce its thickness;

(b) heating the reduced feedstock to a temperature sufficient to anneal and solution heat treat said hot rolled feedstock without intermediate cooling while maintaining the temperature of the reduced feedstock for a time and level sufficient to retain alloying elements in solution;

(c) rapidly quenching the annealed and solution heat treated reduced feedstock to a temperature for cold rolling; and (d) cold rolling the quenched feedstock to produce sheet stock.

21. A method for manufacturing aluminum sheet stock comprising the following steps in a continuous, in-line sequence:

(a) strip or slab casting an aluminum alloy on at least one endless belt to form an aluminum alloy strip.

(b) hot rolling said strip to reduce its thickness;

(c) heat treating said strip to a temperature sufficient to anneal said alloy without intermediate cooling while maintaining the temperature of the reduced feedstock for a time and level sufficient to retain alloying elements in solution; and (d) rapidly quenching said strip.

22. A method for manufacturing aluminum sheet stock comprising the following steps in a continuous, in-line sequence:

(a) strip or slab casting an aluminum alloy by depositing molten alloy on at least one endless belt formed of a heat conductive material whereby the molten metal solidifies on said belt to form a cast strip and continuously cooling the belt when it is not in contact with the metal;

(b) hot rolling said cast strip to reduce its thickness;

(c) heat treating said reduced strip by heating to a temperature sufficient to anneal the alloy without intermediate cooling while maintaining the temperature of the reduced feedstock for a time and level sufficient to retain alloying elements in solution; and;

(d) rapidly quenching said strip.

23. A method as defined in claim 22 which includes the step of cold rolling the quenched strip to produce sheet stock.

24. A method as defined in claim 23 wherein the step of cold rolling is carried out continuously in-line.

25. A method as defined in claim 20 wherein the feedstock has a width of less than 24 inches.

26. A method as defined in claim 21 wherein the feedstock has a width of less than 24 inches.

27. A method as defined in claim 22 wherein the feedstock has a width of less than 24 inches.

* * * * *